US006311356B1

(12) United States Patent
Wang

(10) Patent No.: US 6,311,356 B1
(45) Date of Patent: Nov. 6, 2001

(54) FLOOR CLEANING MACHINE HAVING FORWARDLY PROJECTING BELT

(76) Inventor: Xiao Chun Wang, 2810 Eaglecrest Pl., Diamond Bar, CA (US) 91765

( * ) Notice: Subject to any disclaimer, the term of this patent is extended or adjusted under 35 U.S.C. 154(b) by 0 days.

(21) Appl. No.: 09/371,653

(22) Filed: Aug. 10, 1999

(51) Int. Cl.[7] ..... A47L 11/02
(52) U.S. Cl. ..... 15/99; 15/51
(58) Field of Search ..... 15/99, 51

(56) References Cited

U.S. PATENT DOCUMENTS

| | | | | |
|---|---|---|---|---|
| 557,377 | | 3/1996 | Gee et al. | 15/51 |
| 1,229,648 | | 6/1917 | Olander | 15/51 |
| 1,430,090 | | 9/1922 | Lence | 15/51 |
| 1,522,133 | | 1/1925 | Labiga et al. | 15/51 |
| 1,813,026 | | 7/1931 | Coole | 15/51 |
| 1,827,905 | * | 10/1931 | Picker | 15/99 |
| 2,088,246 | | 7/1937 | Nelson | 15/51 |
| 2,153,686 | | 4/1939 | Deegan, Sr. | 15/51 |
| 2,268,073 | | 12/1941 | Hunn et al. | 15/99 |
| 2,297,107 | * | 9/1942 | Magnuson | 15/99 |
| 2,601,690 | * | 7/1952 | Georgas | 15/99 |
| 2,607,939 | * | 8/1952 | Magnuson | 15/99 |
| 3,052,905 | * | 9/1962 | McMillan et al. | 15/99 |

FOREIGN PATENT DOCUMENTS

| | | | |
|---|---|---|---|
| 184821 | 5/1907 | (DE) | 15/51 |
| 6198 | 3/1912 | (GB) | 15/52.1 |

* cited by examiner

*Primary Examiner*—Gary K. Graham
(74) *Attorney, Agent, or Firm*—Sheldon & Mak

(57) ABSTRACT

A floor cleaner includes a chassis having an elevator mechanism, caster wheels, and a pair of main wheels; a tank removably supported by the chassis for holding cleaning liquid; and a carpet belt. Laterally oriented rollers are supported by the chassis for supporting the carpet belt in a closed path, including a cleaning roller for submerging a portion of the carpet belt within the tank, front and rear wringer rollers, front and rear press rollers, front and rear platen rollers, and an idler roller. A platen member presses the carpet belt against the floor surface. A roller drive rotatably couples the front platen roller to the main wheels for regulating a rate of advancement of the carpet belt during longitudinal movement of the apparatus when the elevator mechanism is in a normal position. The cleaning roller has a raised position clear of the tank, which can be slid on tracks laterally out of the chassis for facilitating lifting of the tank clear of the chassis. The elevator mechanism has a second position for raising the main wheels clear of the floor, and a service position wherein at least one of the main wheels is moved clear of a removal path of the tank. The idler roller is located under the front wringer roller, the carpet belt extending rearwardly from the top of the front platen roller to the bottom of the idler roller for cleaning under low obstructions. Also disclosed is a method for cleaning the floor surface.

13 Claims, 13 Drawing Sheets

FLOOR CLEANING MACHINE HAVING FORWARDLY PROJECTING BELT

BACKGROUND

The present invention relates to devices for cleaning floor surfaces such as wood, vinl, marble, and the like.

Although various types of floor and carpet cleaning devices are known and used, they are not entirely satisfactory for a variety of reasons. For example, 1. They are ineffective in reaching under low cabinet overhangs;
2. They are difficult to service and maintain, particularly in regard to cleaning and refilling of fluid tanks, etc.;
3. They are difficult to maneuver; and
4. They are excessively complex and consequently expensive to provide and unreliable.

Thus there is a need for a floor cleaning device that is easy to maneuver, that can reach under low obstacles, that is easy to service and maintain, and that is reliable and inexpensive to provide.

SUMMARY

The present invention meets this need by providing a modular floor cleaner apparatus that is particularly easy to service and maintain and that is effective for and washing close to vertical obstructions that are under low overhangs. In one aspect of the invention, the apparatus includes a chassis having a main body and a plurality of ground-contacting wheels including a laterally spaced pair of main wheels, for rollably supporting the main body above a floor surface; a laterally extending track slidably supporting a removable tank for holding a quantity of cleaning liquid; an elevator mechanism having a normal position for locating the main wheels laterally spaced from a opposite ends of the track in support of the frame and a service position for displacing at least one of the main wheels clear of a path occupied by the tank when the tank traverses the track to a position normally occupied by the one main wheel; a carpet belt member, opposite ends of the belt member being connected for forming a closed loop of approximately uniform width; a plurality of laterally oriented rollers rotatably supported by the chassis for supporting the carpet belt member in a closed path, a portion of the closed path producing frictional contact between the belt member and the floor surface in the normal position of the elevator mechanism, the rollers including a cleaning roller for submerging a portion of the carpet belt within the tank, a wringer roller located vertically above the cleaning roller for directing the carpet belt out of the tank, a press roller movably located proximate the wringer roller opposite the carpet belt for squeezing liquid from the belt, and a platen roller located proximate a bottom extremity of the chassis; a main handle supported relative to the chassis for manipulating the apparatus on the floor surface; and a roller drive for rotatably coupling at least one of the rollers to at least one of the ground-contacting wheels for regulating a rate of advancement of the carpet belt during longitudinal movement of the apparatus when the elevator mechanism is in the normal position.

Preferably the platen roller is a front platen roller for defining a forward extremity of the closed path, the rollers further including a rear platen roller being located proximate the bottom extremity of the chassis, the belt extending rearwardly from respective upper and lower points of tangency with the front platen roller. The apparatus can further include a platen member supported proximate the bottom extremity of the chassis between the idler and drive rollers for pressing the carpet belt against the floor surface in the at least one operating position of the elevator mechanism. Preferably the apparatus further includes an idler roller spaced behind the front platen roller, the closed path extending externally of the main body generally horizontally from the upper point of tangency with the front platen roller, contacting a lower portion of the idler roller, and extending upwardly therefrom within the main body for permitting cleaning access under a low overhanging obstruction.

The wringer roller can be a first wringer roller, the press roller being a first press roller, the rollers further including a second wringer roller located longitudinally opposite the cleaning roller from the first wringer roller, and a second press roller movably located proximate thereto, whereby the combination of the first and second wringer and press rollers is operative for squeezing liquid from the carpet belt on opposite sides of the cleaning roller. One of the rollers can be movably located for tensioning the carpet belt.

Preferably the cleaning roller can be movably supported between an operating position lowered into the tank and a service position raised out of the tank for permitting removal of the tank from the chassis. The main handle can extend rearwardly of the main body, the apparatus further including an auxiliary handle extending forwardly of the main handle. The auxiliary handle can be adapted for supporting a removable storage container above the main body.

Preferably at least some of the wheels are pivotable caster wheels for facilitating lateral and turning movements as well as longitudinal movements of the apparatus. The elevator mechanism can include a pair of swingable arm members having respective axle shafts to which the main wheels are rotatably mounted, and a latch mechanism for retaining the arm members in the normal position of the elevator mechanism. The normal position of the elevator mechanism can be a first position, there being a second position in addition to the service position, the second position being vertically displaced from the first position for further facilitating manipulation of the apparatus to a desired position and orientation prior to normal operation in the first position.

In another aspect of the invention, a method for cleaning a floor surface includes:

(a) providing a chassis having ground contacting wheels including swivel casters and a pair of main wheels, and a carpet belt movable in a closed path that extends within a tank, and an elevator mechanism having a normal first position for regulating sliding contact between the belt and the floor surface by rolling contact between the main wheels and the floor surface, and a second position permitting rolling of the chassis independently of movement of the carpet belt;

(b) feeding a cleaning liquid into the tank;

(c) positioning the elevator mechanism in the second position;

(d) rolling the chassis to a desired location and orientation on the floor surface;

(e) moving the elevator mechanism to the first position;

(f) advancing the chassis while simultaneously sliding the carpet belt along the floor surface and advancing the carpet belt in the closed path;

(g) progressively rinsing the carpet belt with the cleaning liquid; and (h) progressively squeezing liquid from the carpet belt.

The tank can be removable, being supported laterally movable in a removal path from an operating position located between the main wheels in the normal position of the elevator mechanism, the elevator mechanism having a service position displacing at least one of the main wheels out of the removal path of the tank, the method further including:

(a) moving the elevator mechanism to the service position;

(b) laterally sliding the tank at least partially out of the chassis in the removal path; and (c) lifting the tank from the removal path, prior to the feeding of cleaning fluid into the tank.

DRAWINGS

These and other features, aspects, and advantages of the present invention will become better understood with reference to the following description, appended claims, and accompanying drawings, where:

DESCRIPTION

Figure 1:
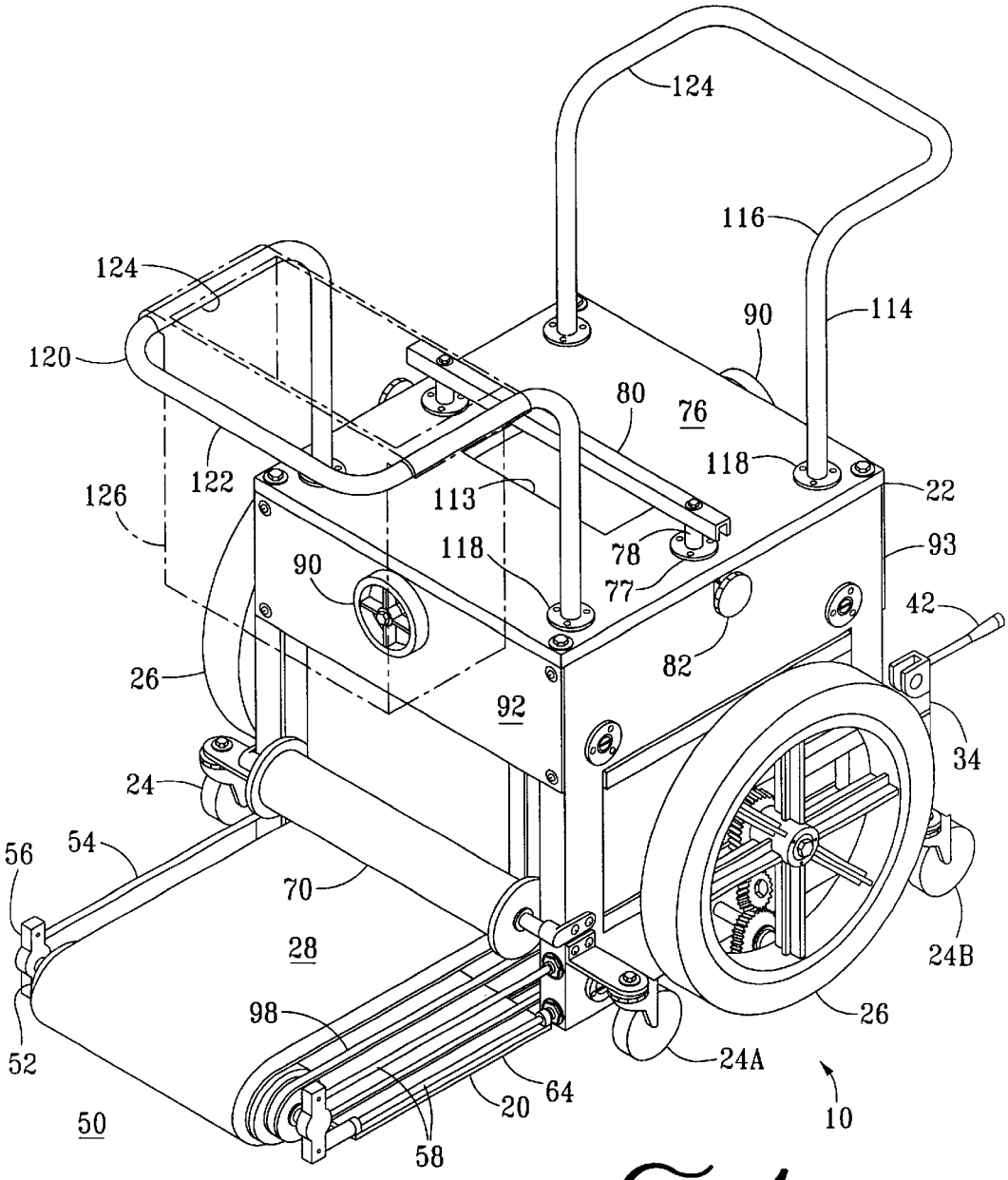
FIG. 1 is a left front perspective view of a floor cleaning machine according to the present invention.

The present invention is directed to a modular floor cleaning machine that is particularly effective for washing in confined spaces. With reference to FIGS. 1–14 of the drawings, a floor cleaning machine 10 includes a chassis 20 having a main body 22, four swivel casters 24, designated front casters 24A and rear casters 24B, a pair of main wheels 26, and a cleaning or carpet belt 28 that is driven on a plurality of rollers as described below. A fluid tank 30 is removably supported within the main body 22 between the main wheels 26 on a laterally extending track that is composed of a parallel spaced pair of tubular track members 32 that project from opposite sides of the main body 22. Each of the main wheels 26 is connected to the chassis 20 by an outwardly swingable elevator arm assembly 34 for enabling access to the tank 30 from either side of the chassis 20.

Figure 2:
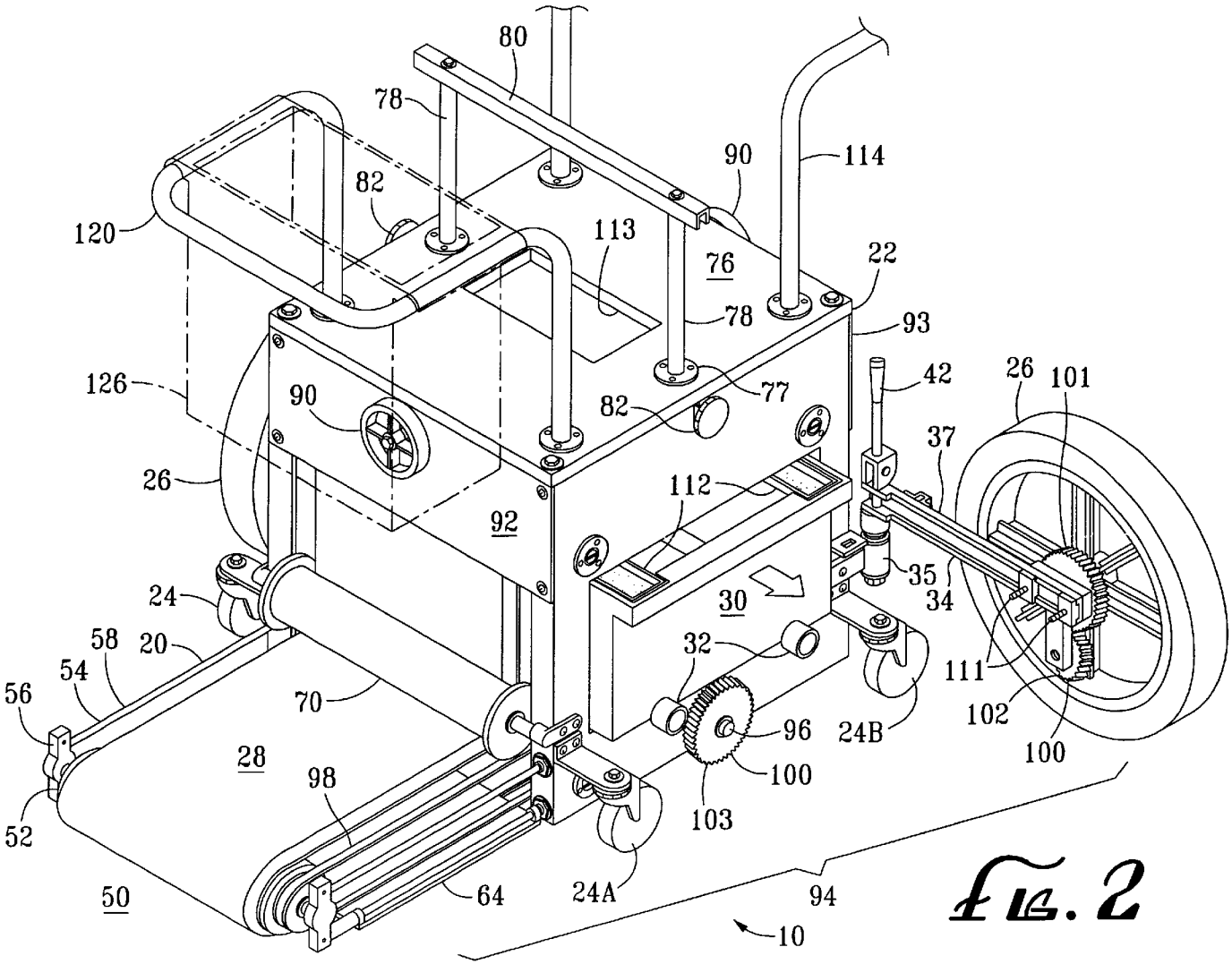
FIG. 2 is a perspective view as in FIG. 1, showing a tank roller carrier and a main wheel thereof moved to respective loading positions.
Figure 5:
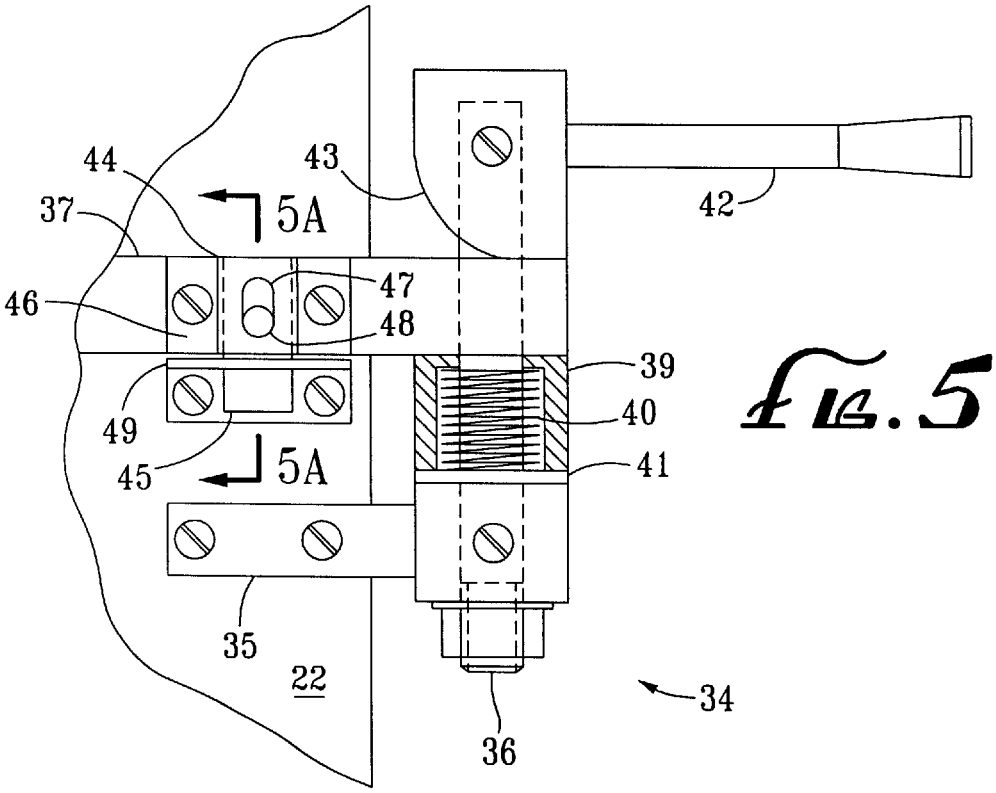
FIG. 5 is a detail view of a wheel latch portion of the machine of FIG. 1 within region 5 of FIG. 4.
Figure 6:
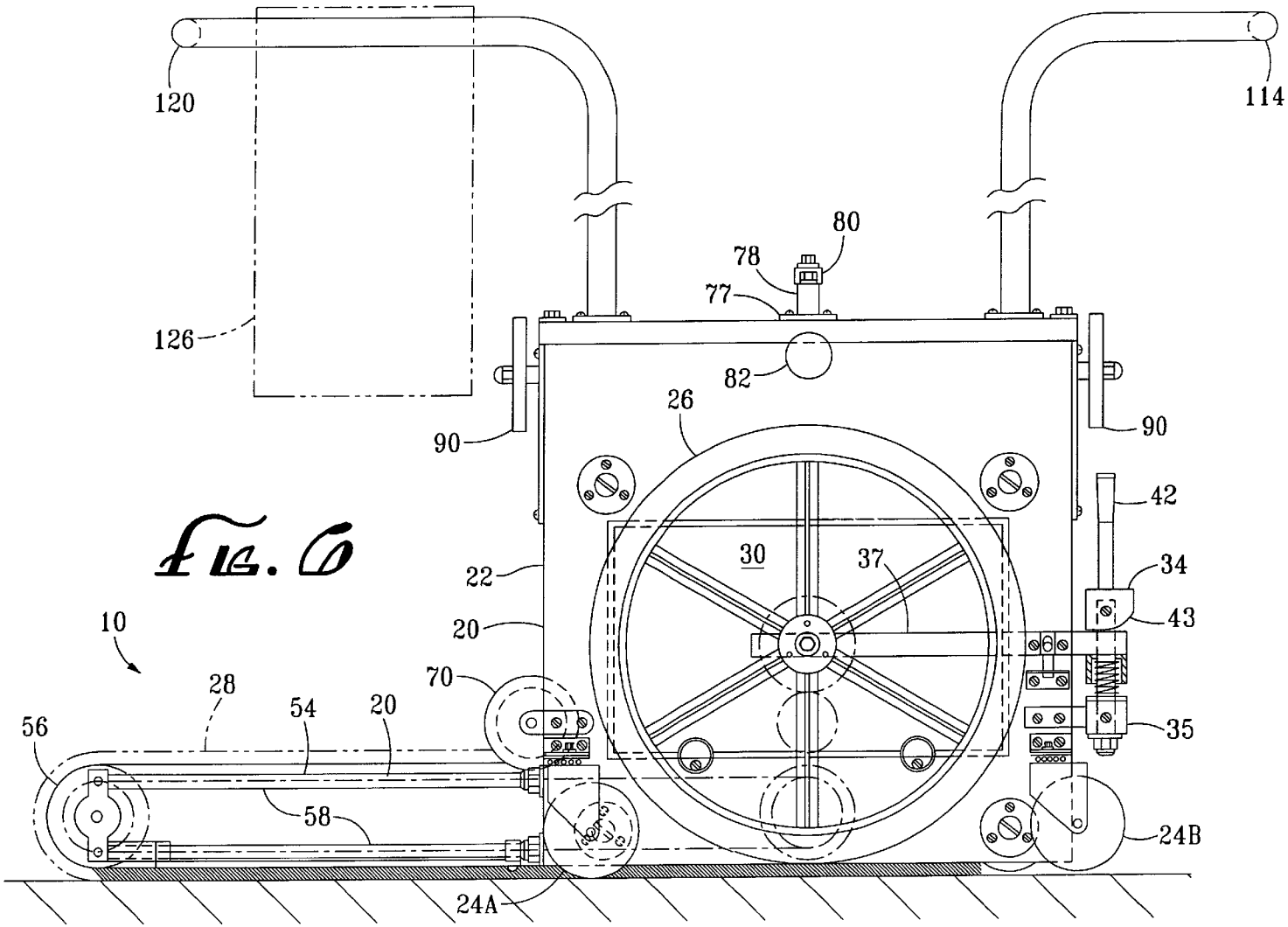
FIG. 6 is an elevational view as in FIG. 4, showing the main wheel in a raised position.
Figure 7:
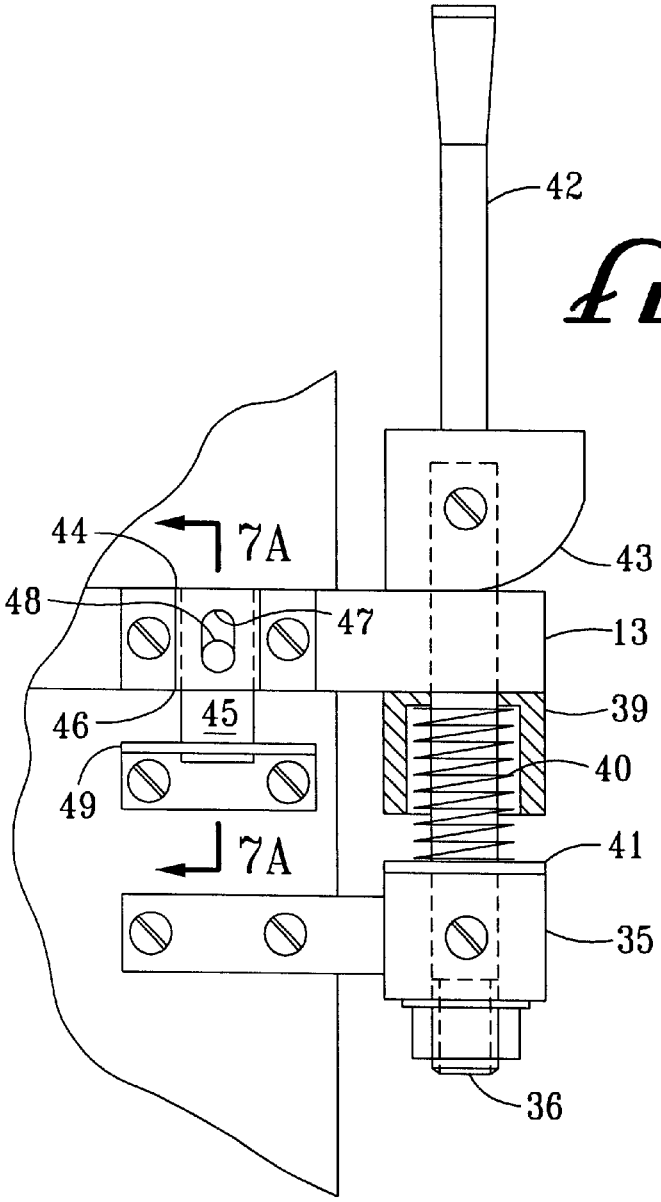
FIG. 7 is a detail view as in FIG. 5, showing the latch portion in the position of FIG. 6.

Each arm assembly 34 includes an anchor bracket 35 that is fastened at a rear corner of the main body 22, a vertically oriented elevator rod 36 rigidly supported by the bracket 35, an arm member 37 that pivotally and slidably engages the elevator rod 36, and an axle member 38 that projects outwardly from a free end of the arm member 37 for rotatably supporting one of the main wheels 26. Also, a flanged collar 39, a helical compression spring 40, and a thrust washer 41 are interposed on the rod 36 between the bracket 35 and the arm member 37, the spring 40 urging the collar 39 away from the washer 41. An elevator handle 42 is pivotally connected to an upper extremity of the rod 36, being movable between a horizontal normal position as shown in FIGS. 1, 4, 5, 8, and 13 for locating the main wheel 26 in a lowered ground-contacting position, and a vertical service position as shown in FIGS. 2, 6, and 7 wherein the main wheel 26 is raised slightly. A root portion of the handle 42 is formed with a cam profile 43 that depresses the arm member 37 when the handle 42 is moved to the normal position, compressing the spring 40 until the collar 39 contacts the washer 41 as best shown in FIG. 5. When the handle 42 is moved to the vertical service position, the cam profile 43 allows the arm member to be displaced upwardly on the rod 36 by the compression spring 40.

Figure 5A:
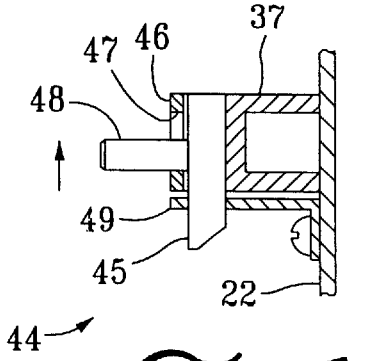
FIG. 5A is a sectional detail view of the latch portion of FIG. 5 on line 5A—5A thereof.
Figure 7A:
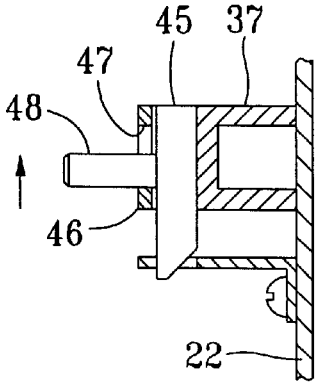
FIG. 7A is a detail view of the latch portion of FIG. 7 on line 7A—7A thereof.

Each elevator arm assembly 34 also includes a latch assembly 44 for locking the arm member in a longitudinal or closed orientation when the handle 42 is in the normal position and selectively releasing the arm member when the handle 42 is in the service position, the arm member 37 then being permitted to swing outwardly for exposing the tank 30 as shown in FIG. 2, the wheel 26 being raised slightly as described above for permitting the outward swinging. The latch assembly 44 includes a beveled bolt member 45 that is slidably supported between the arm member 37 and a retainer 46, the retainer being fastened to the arm member and having a slot 47 formed therein for receiving a bolt handle 48 that rigidly projects from the bolt member 46, the slot 47 limiting vertical movement of the bolt member. The bolt member 45 projects downwardly through a latch plate 49 that is rigidly mounted on the main body 22. When the arm member 37 is in the closed position of FIG. 1 and the elevator handle 42 is in the normal position, the bolt member 46 projects through the latch plate 49 in a lowered position of the bolt member 45 as shown in FIGS. 5 and 5A as well as in a raised position of the bolt member as indicated by the arrow in FIG. 5A, thereby locking the arm member 37 in the closed position regardless of movement of the bolt member 45. In order to move the arm member 37 to the open position, the bolt member 45 must be raised as indicated by the arrow in FIG. 7A when the elevator handle 42 is in the service position as shown in FIGS. 6 and 7.

Figure 8:
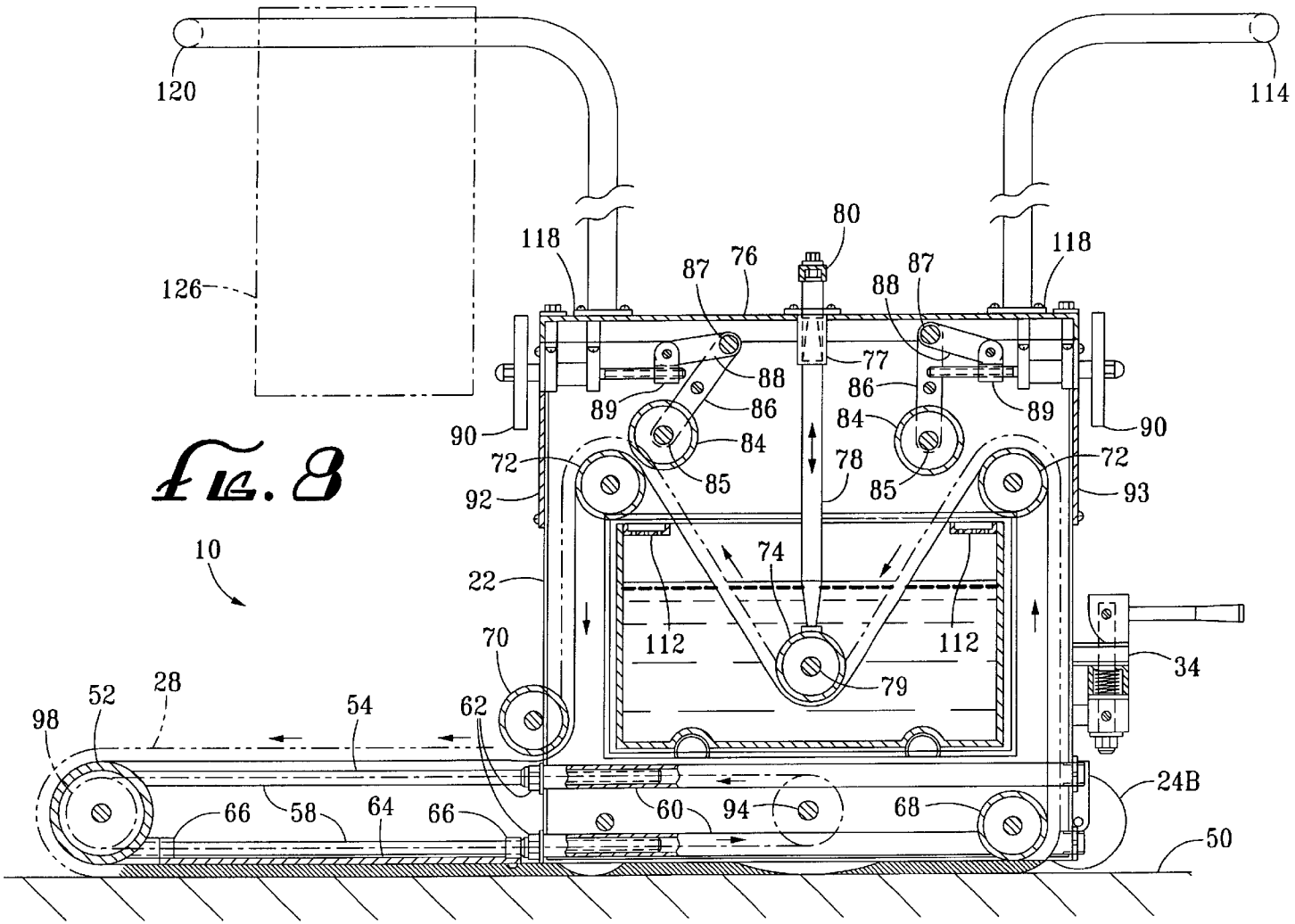
FIG. 8 is a left side sectional elevational view of the machine of FIG. 1 in the condition of FIG. 4.

As shown in FIG. 8, the carpet belt 28 is supported by the chassis 20 in a closed path on a plurality of rollers for slidably contacting a floor surface 50, the rollers including a front platen roller 52 that is supported on a chassis extension 54 proximate the bottom of the chassis 20, in forwardly spaced relation to the main body 22. The chassis extension 54 includes a pair of bearing blocks 56 for rotatably supporting opposite ends of the roller 52, a pair of cylindrical (tubular) extension members 58 extending rigidly rearwardly from each block 56 and having telescoping engagement with a respective support tube 60 that is fixedly supported longitudinally within the main body 22. An extension nut 62 threadingly engages each of the extension members 58, each nut 62 abutting a forward extremity of a respective support tube 60, thereby adjustably spacing the bearing blocks forwardly of the main body 22 for purposes described below. A platen member 64 is supported below the chassis extension 54 for pressing the carpet belt against the floor surface 50, the platen member being fastened to respective pairs of hanger members 66 that are threaded onto a lower pair of the extension members 58, being captured between the bearing blocks 56 and a corresponding lower pair of the support tubes 60.

A rear platen roller 68 is supported within the main body 22 proximate the bottom of the chassis 20, behind the platen member 64, the carpet belt passing smoothly under the platen member 64 between the platen rollers 52 and 68, tangentially contacting the rollers proximate bottom extremities thereof. The carpet belt extends rearwardly from proximate a top extremity of the front platen roller 52, contacting the underside of an idler roller 70 that is rotatably supported within the main body 22 for facilitating cleaning portions of the floor surface that may extend under low obstructions.

Figure 9:
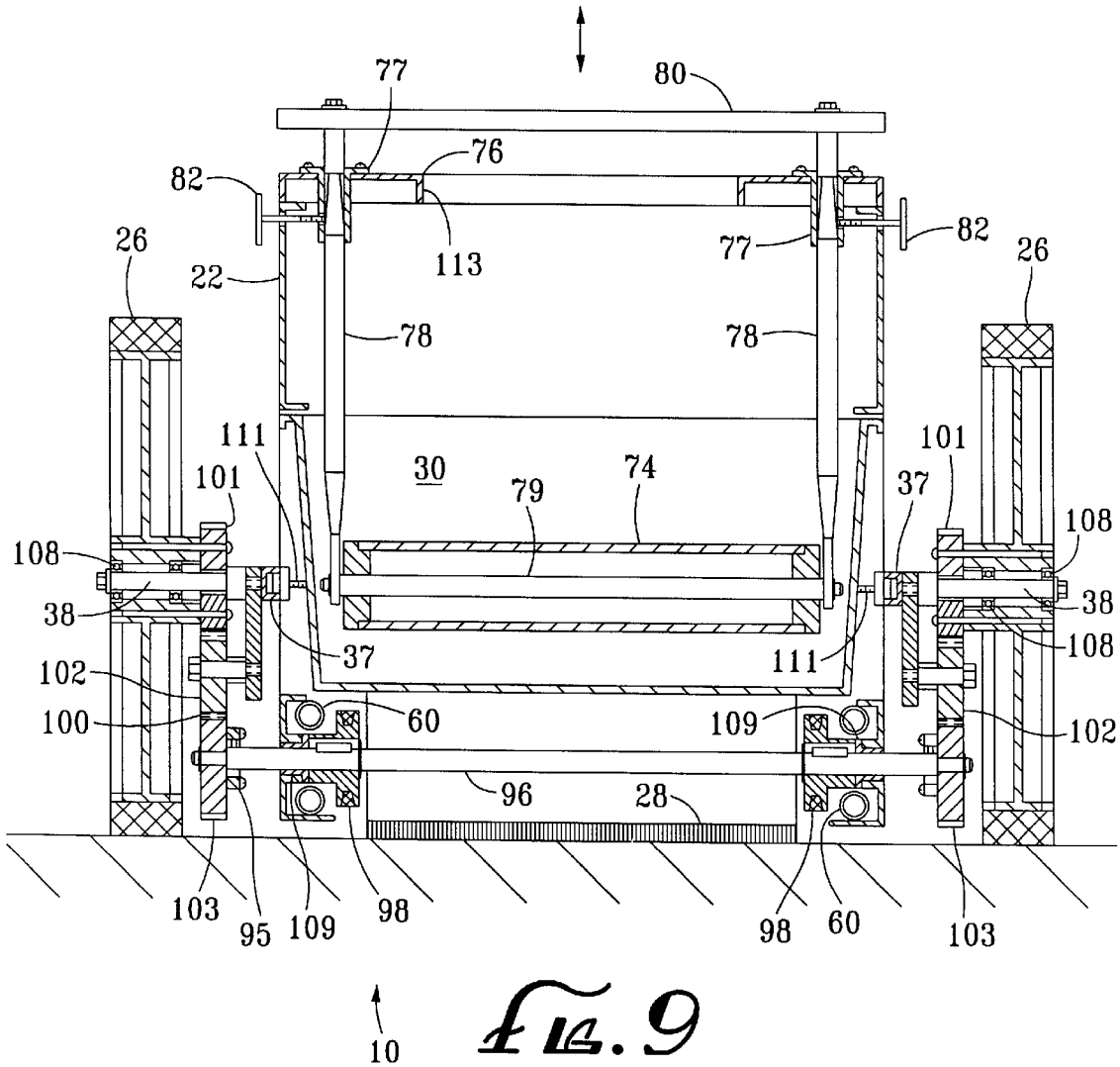
FIG. 9 is a lateral sectional view of the machine of FIG. 1 in the condition of FIG. 4.
Figure 10:
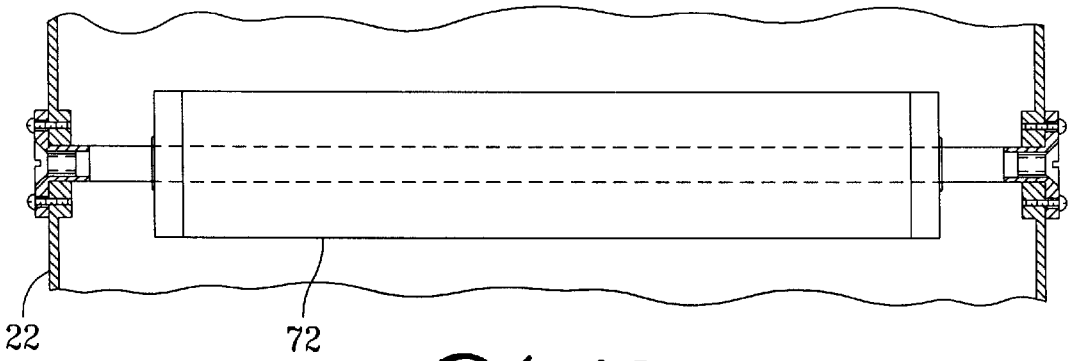
FIG. 10 is a lateral sectional view of a wringer roller portion of the machine of FIG. 1.
Figure 11:
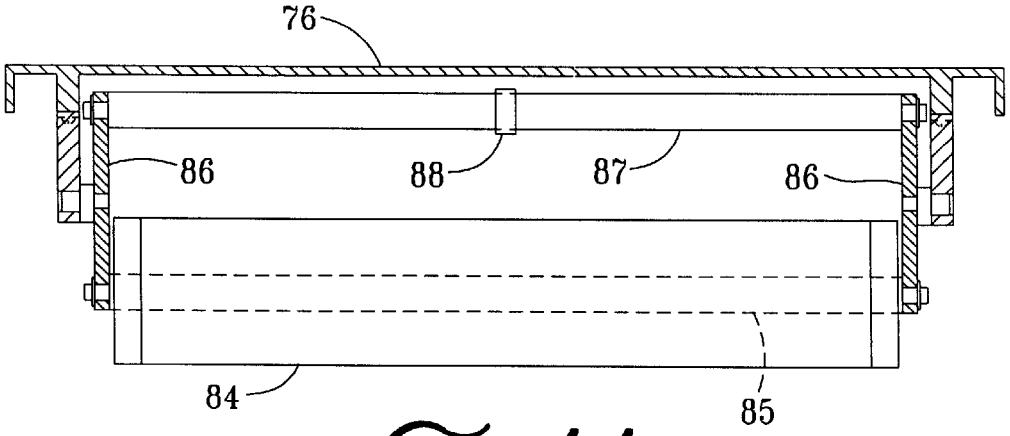
FIG. 11 is a lateral sectional view of a press roller portion of the machine of FIG. 1.

The carpet belt 28 is also supported by a longitudinally spaced pair of wringer rollers 72 and a cleaning roller 74, the cleaning roller being movably supported as best shown between a lowered operating position for submerging a portion of the carpet belt within the fluid tank 30 and a service position raised clear of the fluid tank 30 as indicated by dashed lines in FIGS. 8 and 9, thereby permitting the tank 30 to be slid on the track members 32 as described above. More particularly, a top plate 76 of the main body 22 has a pair of flanged collars 77 fixedly projecting therethrough for slidably holding respective vertically oriented support rods 78, a roller shaft 79 extending between bottom extremities of the rods 78 for rotatably supporting the cleaning roller 74. A handle bar 80 is fastened between upper extremities of the support rods 78 for moving the roller 74 up and down, a thumb screw 82 threadingly engaging each of the collars 77 for selectively locking the support rods 78 in the operating and service positions of the cleaning roller 74.

A pair of press rollers 84 are movably supported proximate respective ones of the wringer rollers 72 for squeezing cleaning liquid from the carpet belt 28, the press rollers 84 being rotatably mounted on respective roller shafts 85, opposite ends of each roller shaft 85 rigidly engaging a pair of press levers 86 that are pivotally supported within the main body 22. A pair of press bars 87 rigidly connects respective pairs of the press levers 86, each press bar 87 being coupled by a pivoting link 88 to an adjustment block 89 that threadingly engages a handwheel 90 being rotatably supported by the top plate 76 of the main body 22. Thus each roller shaft 85, press bar 87, and corresponding pair of press levers 86 forms a rigid press frame that is pivotally movable within the main body in response to rotation of the respective handwheels 90 for adjustably spacing the press rollers from the corresponding wringer rollers 72. As further shown in FIG. 8, the handwheels 90 project through respective front and rear body panels 92 and 93 of the main body 22.

A drive mechanism 94 that includes a pair of one-way drives 95 rotatably couples the main wheels 26 to the front platen roller 52 for regulating rotation of the front platen roller 52 in the same direction as the main wheels 26. In the exemplary embodiment of the machine 10 as shown in the drawings, the drive mechanism 94 operates at an approximate one-to-one rate of rotation between the main wheels 26 and the front platen roller 52; however, the main wheels 26 are significantly larger in diameter than the roller 52. Accordingly, frictional contact between the carpet belt 28 and the floor surface 50 during forward movement of the chassis 20, urges advancement of the belt 28 in the closed path with the belt making progressive stationary contact with the floor surface, but the drive mechanism 94 restricts the advancement of the belt 28 in the closed path, resulting in progressive sliding engagement of the full length of the belt 28 against the floor surface during continued forward movement of the chassis 20 when the elevator arm assemblies are in the normal (lowered) position. The one-way drives 95 are located at opposite ends of a transversely oriented main shaft 96, the shaft 96 being coupled to opposite ends of the platen roller 52 by a pair of belt drives 98. Also, each of the arm members 37 of the elevator arm assembly 34 supports a gear train 100, each gear train 100 including a drive gear 101 that is rigidly mounted to a respective main wheel 26 concentric with the corresponding axle shaft 38 and mating with an idler gear 102 that is rotatably supported in depending relation to the drive gear 101 as best shown in FIGS. 2 and 9. Each of the one-way drives 95 has a driven gear 103 mounted thereto for mating with the corresponding idler gear 102 when the corresponding elevator arm assembly 34 is in its normal (lowered) position.

Figure 12B:
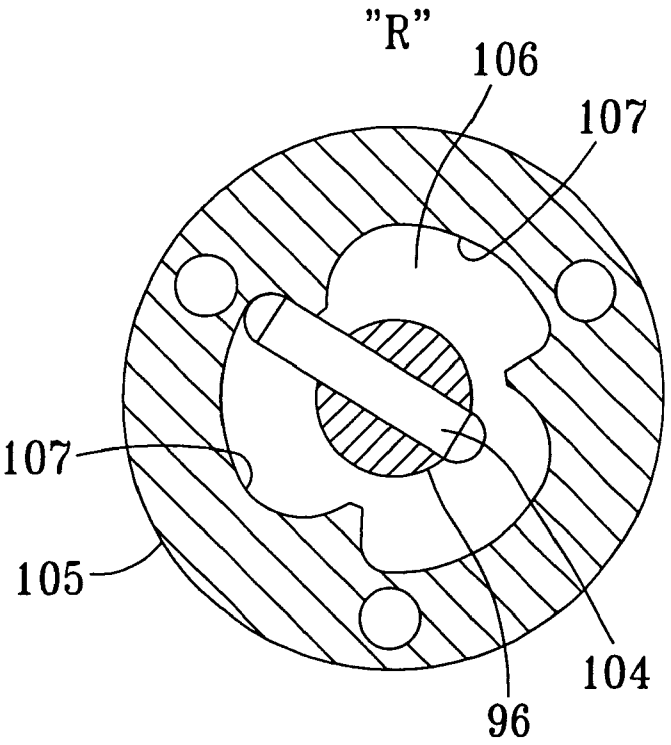
FIG. 12B is a sectional detail view of a right-side one-way drive assembly of the machine of FIG. 1 on line 12B—12B of FIG. 9.
Figure 12A:
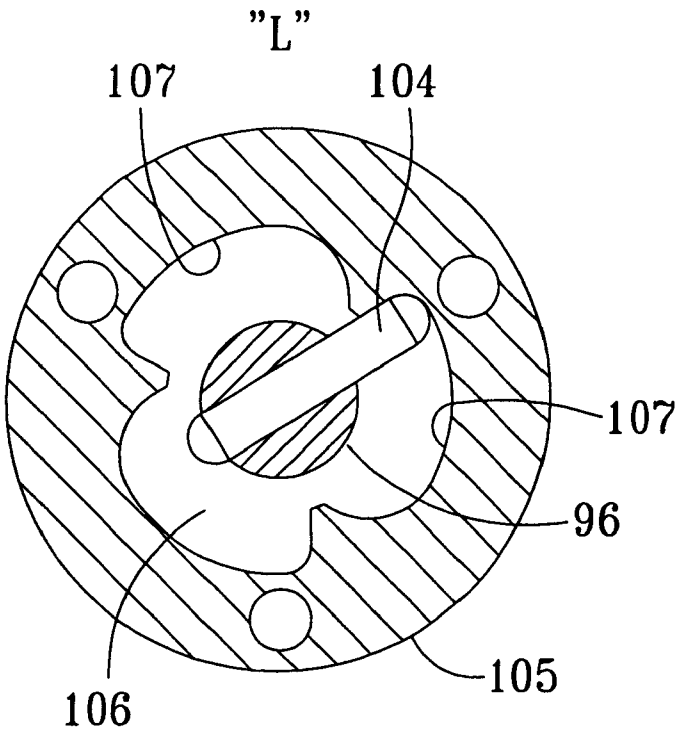
FIG. 12A is a sectional detail view of a left-side one-way drive assembly of the machine of Fig. 1 on line 12A—12A of FIG. 9.
Figure 13:
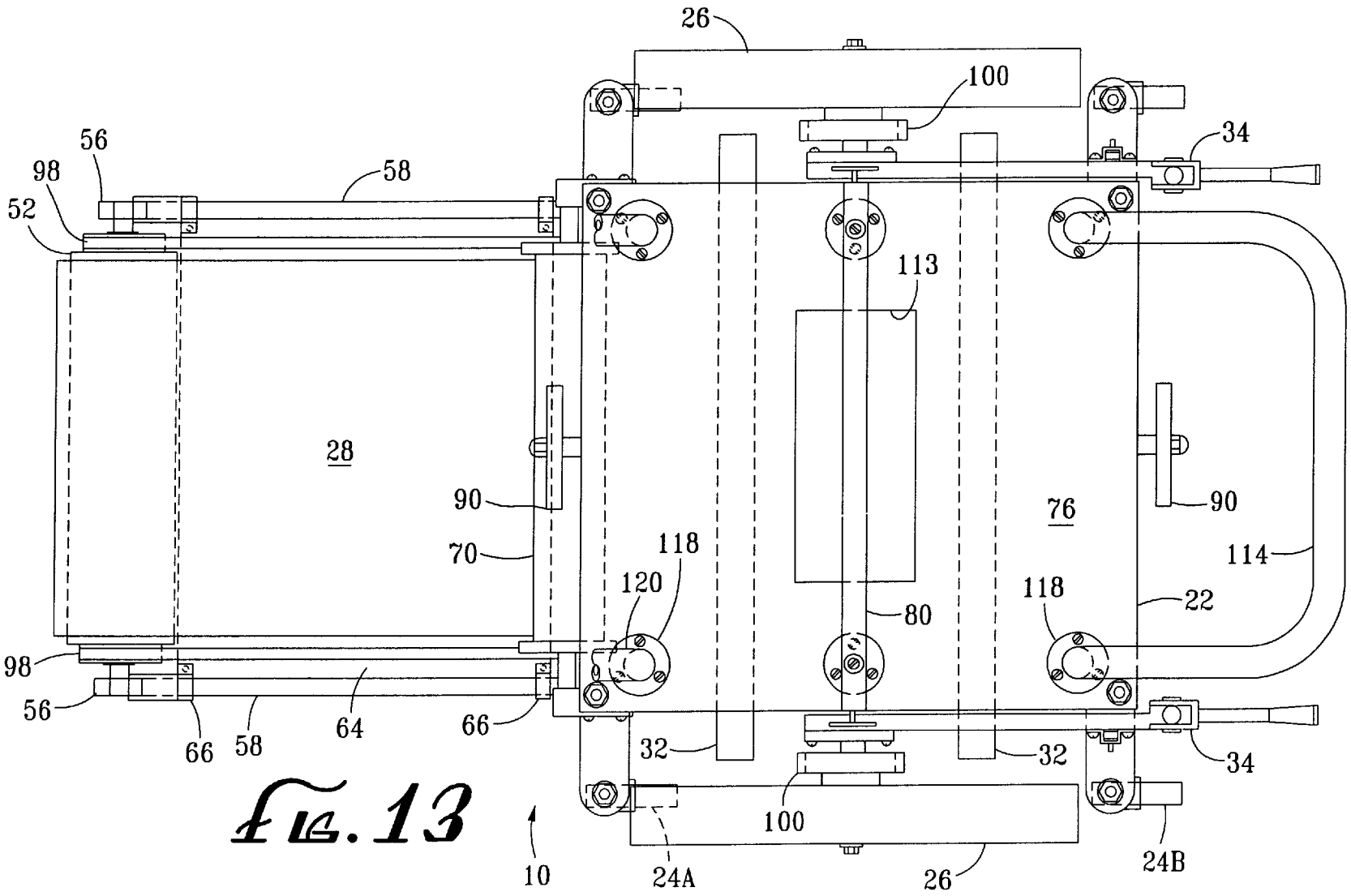
FIG. 13 is a plan view of the machine of FIG. 1.
Figure 14:
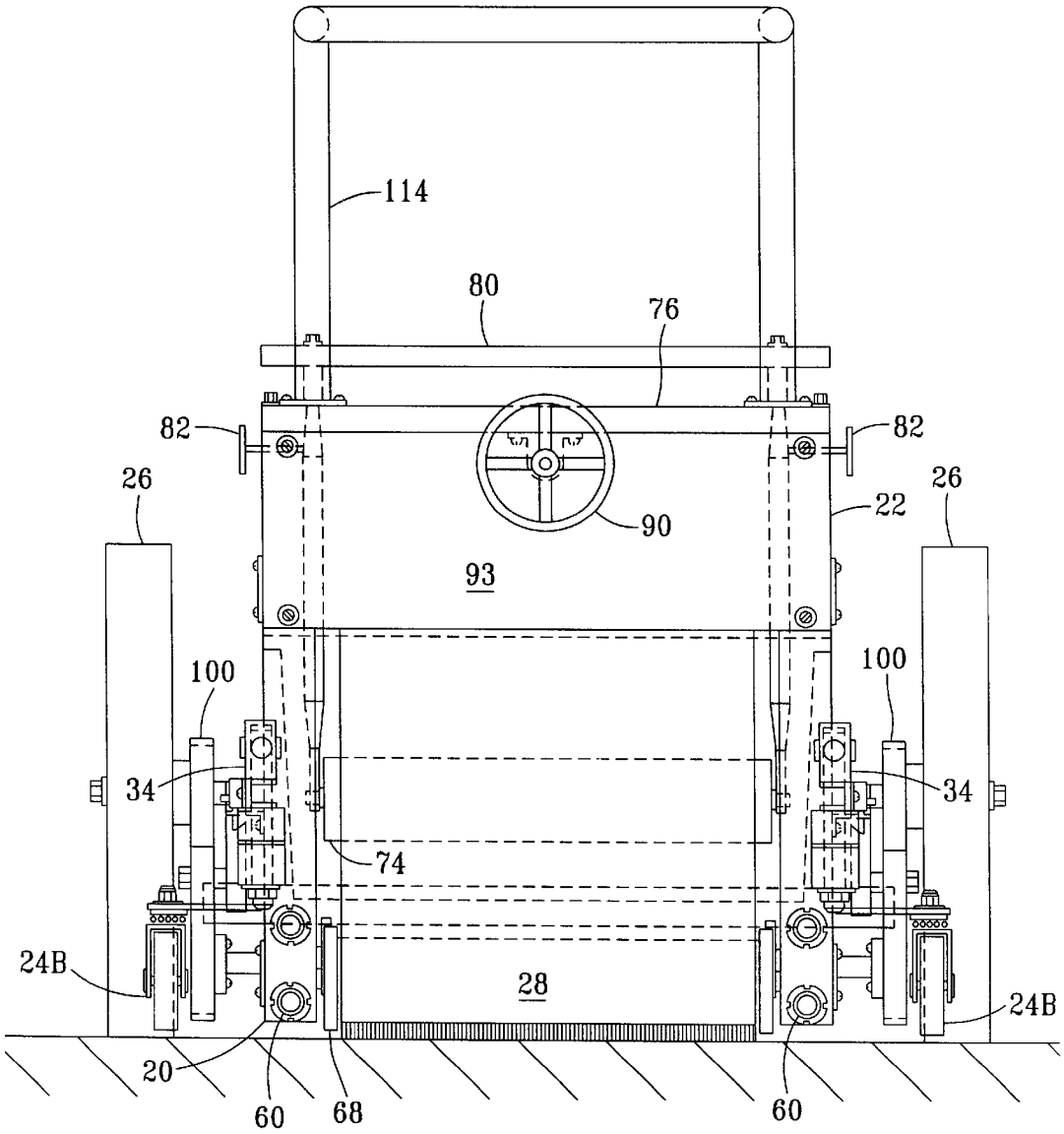
FIG. 14 is a rear elevational view of the machine of FIG. 1.

As shown in FIGS. 12A and 12B, each of the one-way drives 95 includes a cylindrical pawl member 104 having rounded ends, the pawl member slidably projecting through the main shaft 96 within a ring member 105 having the driven gear 103 mounted thereto. The ring member 105 is formed with an internal cavity 106 having an odd number (three) of asymmetrical enlargements 107 that are shaped for permitting rotation relative to the main shaft 96 in one direction only. More particularly, in a direction of free rotation, alternating ends of the pawl member 104 slidably engage sloping portions of successive ones of the enlargements 107; however, a cylindrical portion of the pawl member 104 comes into rigidly abutting engagement with a radially extending portion of an enlargement 107 when the ring member 105 begins to rotate in the opposite direction relative to the main shaft 96. The one-way drives 95 are oriented as indicated in FIGS. 12A and 12B for symmetrical regulation of the front platen roller 52 relative to left- and right-turning maneuvers of the machine 10 on the floor surface 50, the rate of rotation of the platen roller 52 being dictated by the main wheel 26 having the slowest forwardly rotating speed.

When the elevator arm assemblies 34 are in the second (raised) position, the idler gears 102 are shifted out of engagement with the driven gears 103, thus releasing the drive mechanism 94 to permit free circulation of the carpet belt 28, thereby facilitating positioning of the machine 10 at a desired location of the floor surface 50 to be cleaned.

The platen rollers 52 and 68, the idler roller 70, the wringer rollers 72, and the press rollers 84, as well as the idler gears 102, are provided with suitable bearings (not shown). As shown in FIG. 9, the main wheels 26 are provided with pairs of antifriction bearings 108, and the main shaft is supported on a pair of flanged bearings 109, the selection of suitable bearings being within the ordinary skill of the art.

As described above, the bearing blocks 56 are adjustably spaced forwardly of the main housing 22 by the extension nuts 62, thereby adjustably locating the front platen roller 52 for suitably tensioning the belt drives 98. The carpet belt 28 is tensioned about the front platen roller 52 by adjustably locating the cleaning roller 74 as described herein. Particularly, the support rods 78 are conically tapered at locations engaged by the thumb screws 82, for securing the cleaning roller selectively vertically positioned for maintaining a desired tension of the carpet belt 28. Prior to tightening the thumb screws 82, the handle bar 80 is depressed for obtaining the desired location of the cleaning roller 74.

The carpet belt 82 contacts the underside of idler roller 70 as described above, passing over the wringer rollers 72 and under the cleaning roller 74, being compressed on the wringer rollers 72 by the corresponding press rollers 84, the belt 28 then passing behind and under the rear platen roller 68, and from there under the platen member 64 and back to the front platen roller 52 as described above, thereby completing the closed path. The carpet belt can be formed of a strip of flexible material having nylon bristles extending therefrom, the bristles having sufficient length and stiffness for repeatably compressing approximately 0.5 inch when being pressed against the floor surface. Opposite ends of the strip are connected in any suitable manner permitting continuous closed path movement over the rollers. The platen member 64 is rigidly positioned proximate a lower extremity of the chassis 20 for pressing the carpet belt 28 against the floor surface 50 as the machine 10 is advanced over the floor surface 50 as described above, the cleaning roller 74 progressively wetting and rinsing the carpet belt 28, the tank 30 extending to proximate the carpet belt 28 on opposite sides of the wringer rollers 72 for collecting liquid being squeezed from the belt 28. In the exemplary configuration of the machine 10 as shown in the drawings, a suitable width of the carpet belt 28 is from approximately 15 inches to approximately 20 inches, the belt 28 having a circumferential length of approximately 120 inches.

Figure 3:
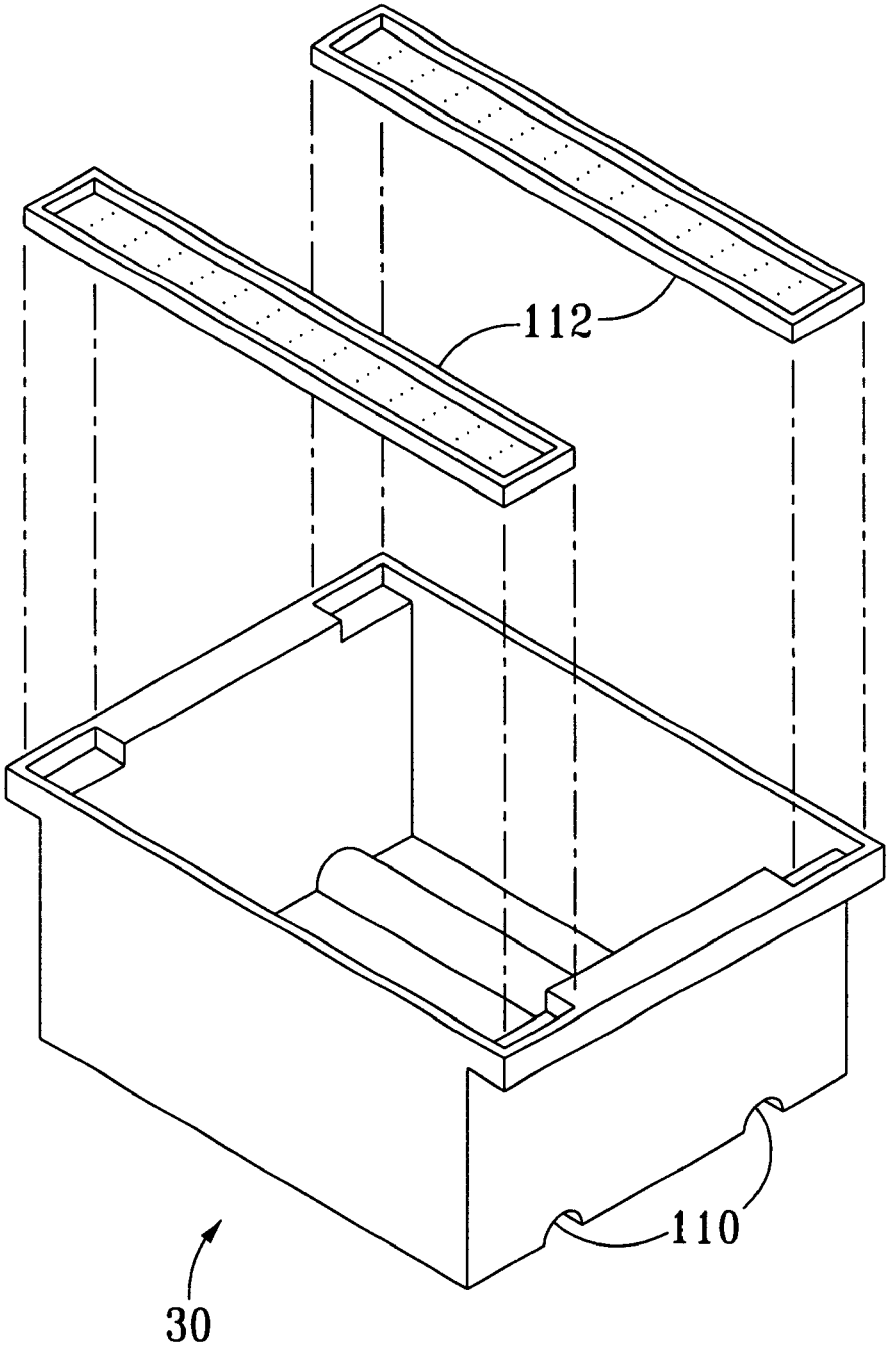
FIG. 3 is an exploded perspective view of a tank unit of the machine of FIG. 1.

As best shown in FIG. 3, the tank 30 is formed with arch-shaped track-engaging contours 110 for registration on the track members 32 as best shown in FIGS. 2 and 8. The open top of the tank 30 is sufficiently wide to receive the full width of the carpet belt 28, extending also laterally beyond opposite ends of the wringer rollers 72. Further, the open top of the tank 30 is sufficiently long to extend under lower extremities of the wringer rollers 72 thereby to collect cleaning fluid that is expected to drip therefrom. Also, the tank 30 is retained in its centered position within the main body 22 by pairs of retainer screws 111 that project inwardly from each of the arm members 37 when the respective elevator arm assemblies 34 are in their inward (closed) positions as shown in FIG. 9. Further, the tank 30 is provided with a pair of removably supported strainers 112 for collecting lint and/or other solid contaminants that may fall from the wringer rollers 72 as shown in FIG. 3. Moreover, the strainers 112 are advantageously effective for avoiding spillage of fluid from the tank 30 when the machine 10 is accelerated longitudinally on the floor surface 50. In addition to the tank 30 being removable for servicing as described above, the top plate 76 has an opening 113 formed therein for permitting fluid to be added when the tank 30 is installed in its normal position within the main body 22.

The machine 10 also has a main handle assembly 114 by which the machine 10 can be moved about or otherwise maneuvered on the floor surface 50. The main handle assembly 114 extends rearwardly of the main body 22 and includes a generally U-shaped main handle member 116 that can be formed from a tubular member, opposite extremities of the tubular member being rigidly mounted to the top plate 76 of the main body 22 by a pair of handle flanges 118. Optionally, the machine is also provided with an auxiliary handle assembly 120 that can include counterparts of the main handle member and the handle flanges 118. Preferably the auxiliary handle assembly 120 extends more forwardly of the main body 22 than the main handle assembly extends rearwardly thereof, for facilitating manipulation by a person standing forwardly of the chassis extension 54. Accordingly, the exemplary configuration of the machine 10 has the auxiliary handle assembly including an auxiliary handle member 122 that is longitudinally extended relative to the main handle member 116. Further, the handle members 116 and 122 are each formed having parallel-spaced horizontally extending portions 124 for stable support of miscellaneous implements and/or devices as may be employed in conjunction with use of the machine 10. For example, the auxiliary handle assembly 120 optionally supports a removable storage bin 126 on the horizontally extending portions 124 thereof as indicated by broken lines in the drawings. It will be understood that a counterpart of the bin 126 (longitudinally foreshortened if necessary) can also be supported in like manner on the main handle assembly 114.

In use, a suitable cleaning fluid is poured into the tank 30, normally following removal of the tank from the chassis 20 as described above. Next, with the cleaning roller 74 and the elevator arm assemblies moved to the service positions thereof, the tank 30 is loaded onto the track members 32 and slid thereon into a centered position within the main body 22. Then the elevator arm assemblies 34 are pivoted inwardly and latched in the second position thereof by the latch assemblies 44, and the cleaning roller 74 is secured in the operating position thereof by first loosening the thumb screws 82, lowering the handle bar 80, and then re-tightening the thumb screws 82. The machine 10 is manipulated as desired to a portion of the floor surface 50 to be cleaned, then the elevator arm assemblies are moved to the normal first (lowered) position by lowering the elevator handles 42. The carpet belt 28 then makes sliding contact with the floor surface 50 as regulated by the main wheels 26 through the drive mechanism 94 as the machine is moved forwardly by the main handle assembly 114 (and/or by the auxiliary handle assembly 120). For example, with the front platen roller 52 having a diameter approximately 20 percent of the diameter of the main wheels 26 and the drive mechanism 94 having a ratio of 1:1, the carpet belt 28 moves relative to the chassis 20 at approximately 20 percent of a peripheral velocity of the main wheels 26. Thus the carpet belt makes sliding contact with the floor surface 50 at approximately 80 percent of a travel velocity of the machine 10 over the floor surface 50, provided that there is no significant slippage of the main wheels 26 on the floor surface 50. It will be appreciated that the intended sliding contact by the carpet belt 28 is attained with the frictional drag of the belt 28 within the main module 12 is less than the frictional drag between the carpet belt 28 and the floor surface 50, and the frictional engagement of the main wheels 26 with the floor surface is not less than 20 percent of the difference between the drag between the carpet belt 28 and the floor surface 50 and that within the main module 12.

Figure 4:
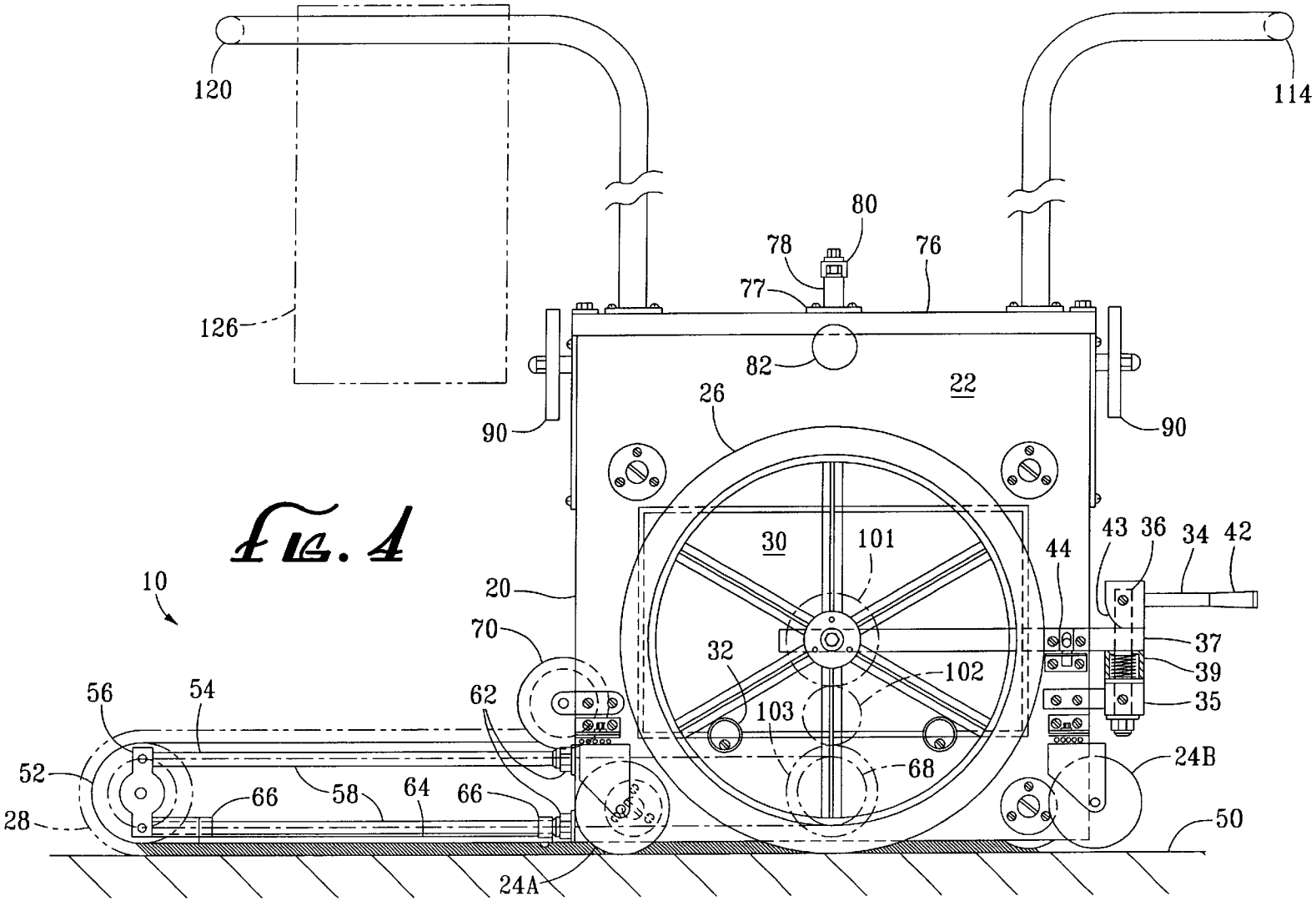
FIG. 4 is a left side elevational view of the machine of FIG. 1, showing the main wheel in a lowered position.

In the normal first (lowered) position of the elevator arm assemblies 34, the full weight of the machine 10 is shared between the carpet belt 28 and the main wheels 26, (and possibly by the front casters 24A) as shown in FIG. 4. In the second (raised) position of the elevator arm assemblies, the main wheels 26 are lifted away from the floor surface 50, the weight of the machine is shared by the front casters 24 and the carpet belt 28, except that downward pressure on the main handle assembly 114 shifts loading from the front casters 24A to the rear casters 24B as the chassis 20 is tilted slightly rearwardly.

Although the present invention has been described in considerable detail with reference to certain preferred versions thereof, other versions are possible. For example, the drive mechanism 94 can be coupled to others of the rollers, such as one or both of the wringer rollers 72 instead of or in addition to being coupled to the front platen roller 52. Therefore, the spirit and scope of the appended claims should not necessarily be limited to the description of the preferred versions contained herein.

What is claimed is:

1. Apparatus for cleaning a floor surface, comprising:

(a) a chassis having a main body and a plurality of ground-contacting wheels including a laterally spaced pair of main wheels, for rollably supporting the main body above the floor surface;

(b) a laterally extending track slidably supporting a removable tank for holding a quantity of cleaning liquid;

(c) an elevator mechanism having a normal position for locating the main wheels laterally spaced from opposite ends of the track in support of the frame and a service position for displacing at least one of the main wheels clear of a path occupied by the tank when the tank traverses the track to a position normally occupied by the one main wheel;

(d) a carpet belt member, opposite ends of the belt member being connected for forming a closed loop of approximately uniform width;

(e) a plurality of laterally oriented rollers rotatably supported by the chassis for supporting the carpet belt member in a closed path, a portion of the closed path producing frictional contact between the belt member and the floor surface in the normal position of the elevator mechanism, the rollers including:

(i) a cleaning roller for submerging a portion of the carpet belt within the tank;

(ii) a wringer roller located vertically above the cleaning roller for directing the carpet belt out of the tank;

(iii) a press roller movably located proximate the wringer roller opposite the carpet belt for squeezing liquid from the belt; and (iv) a platen roller located proximate a bottom extremity of the chassis;

(f) a main handle supported relative to the chassis for manipulating the apparatus on the floor surface; and (g) a roller drive for rotatably coupling at least one of the rollers to at least one of the ground-contacting wheels for regulating a rate of advancement of the carpet belt during longitudinal movement of the apparatus when the elevator mechanism is in the normal position.

2. The apparatus of claim 1, wherein the platen roller is a front platen roller for defining a forward extremity of the closed path, the rollers further including a rear platen roller being located proximate the bottom extremity of the chassis, the belt extending rearwardly from respective upper and lower points of tangency with the front platen roller.

3. The apparatus of claim 2, further comprising a platen member supported proximate the bottom extremity of the chassis between the idler and drive rollers for pressing the carpet belt against the floor surface in the at least one operating position of the elevator mechanism.

4. The apparatus of claim 2, further comprising an idler roller spaced behind the front platen roller, the closed path extending externally of the main body generally horizontally from the upper point of tangency with the front platen roller, contacting a lower portion of the idler roller, and extending upwardly therefrom within the main body for permitting cleaning access under a low overhanging obstruction.

5. The apparatus of claim 1, wherein the wringer roller is a first wringer roller and the press roller is a first press roller, the rollers further including a second wringer roller located longitudinally opposite the cleaning roller from the first wringer roller, and a second press roller movably located proximate thereto, whereby the combination of the first and second wringer and press rollers is operative for squeezing liquid from the carpet belt on opposite sides of the cleaning roller.

6. The apparatus of claim 1, wherein one of the rollers is movably located for tensioning the carpet belt.

7. The apparatus of claim 1, wherein the cleaning roller is movably supported between an operating position lowered into the tank and a service position raised out of the tank for permitting removal of the tank from the chassis.

8. The apparatus of claim 7, wherein the main handle extends rearwardly of the main body, the apparatus further including an auxiliary handle extending forwardly of the main handle.

9. The apparatus of claim 8, wherein the auxiliary handle is adapted for supporting a removable storage container above the main body.

10. The apparatus of claim 1, wherein at least some of the wheels are pivotable caster wheels for facilitating lateral and turning movements as well as longitudinal movements of the apparatus.

11. The apparatus of claim 10, wherein the elevator mechanism includes a pair of swingable arm members having respective axle shafts to which the main wheels are rotatably mounted, and a latch mechanism for retaining the arm members in the normal position of the elevator mechanism.

12. The apparatus of claim 1, wherein the normal position of the elevator mechanism is a first position, there being a second position in addition to the service position, the second position being vertically displaced from the first position.

13. Apparatus for cleaning a floor surface, comprising:

(a) a chassis having a main body and a plurality of ground-contacting wheels including a laterally spaced pair of main wheels, for rollably supporting the main body above the floor surface;

(b) a laterally extending track slidably supporting a removable tank for holding a quantity of cleaning liquid;

(c) an elevator mechanism having a normal position for locating the main wheels laterally spaced from opposite ends of the track in support of the frame and a service position for displacing at least one of the main wheels clear of a path occupied by the tank when the tank traverses the track to a position normally occupied by the one main wheel;

(d) a carpet belt member, opposite ends of the belt member being connected for forming a closed loop of approximately uniform width;

(e) a plurality of laterally oriented rollers rotatably supported by the chassis for supporting the carpet belt member in a closed path, a portion of the closed path producing frictional contact between the belt member and the floor surface in the normal position of the elevator mechanism, the rollers including:

(i) a cleaning roller movably supported by the chassis and having an operating position for submerging a portion of the carpet belt within the tank, and a service position lifted clear of the tank for permitting removal of the tank from the chassis;

(ii) a first wringer roller located vertically above and ahead of the cleaning roller for directing the carpet belt out of the tank;

(iii) a second wringer roller located longitudinally opposite the cleaning roller from the first wringer roller;

(iv) a first press roller biasingly located proximate the first wringer roller opposite the carpet belt for squeezing liquid from the belt;

(v) a second press roller biasing located proximate the second wringer roller, whereby the combination of the first and second wringer and press rollers is operative for squeezing liquid from the carpet belt on opposite sides of the cleaning roller;

(vi) a front platen roller located proximate the bottom extremity of the chassis and defining a forward extremity of the closed path;

(vii) an idler roller spaced behind the front platen roller, the closed path extending externally of the main body generally horizontally from the upper point of tangency with the front platen roller, contacting a lower portion of the idler roller, and extending generally upwardly therefrom to the first wringer roller for permitting cleaning access under a low overhanging obstruction; and (viii) a rear platen roller located proximate a bottom extremity of the chassis behind the front platen roller, one of the rollers being movably located for tensioning the carpet belt;

(f) an insert member removably supported by the chassis, the cleaning roller and the press roller being supported by the insert member, whereby the carpet belt is released from the closed path upon removal of the insert member;

(g) a main handle mounted to the chassis and projecting rearwardly of the main body for manipulating the apparatus on the floor surface;

(h) a roller drive for rotatably coupling the front platen roller to at least one of the main wheels for regulating a rate of advancement of the carpet belt during longitudinal movement of the apparatus when the elevator mechanism is in the normal position; and (i) a platen member supported proximate the bottom extremity of the chassis between the front and rear platen rollers for pressing the carpet belt against the floor surface.

* * * * *